US006334086B1

(12) United States Patent
Park et al.

(10) Patent No.: US 6,334,086 B1
(45) Date of Patent: Dec. 25, 2001

(54) METHOD AND APPARATUS FOR COLLECTING TRAFFIC INFORMATION

(75) Inventors: Jong-Hun Park, Kyongki-do; Young-Dal Sin, Inchun-shi; Joong-Hyup Ko, Kyongki-do; Dong-Joon Kim, Seoul; Seo-Yong Jin, Dongjack-gu, all of (KR)

(73) Assignee: ROTIS Inc. (Road Traffic Information Systems), Seoul (KR)

( * ) Notice: Subject to any disclaimer, the term of this patent is extended or adjusted under 35 U.S.C. 154(b) by 0 days.

(21) Appl. No.: 09/522,713

(22) Filed: Mar. 10, 2000

(51) Int. Cl.[7] ..... C06G 7/70

(52) U.S. Cl. ..... 701/117; 701/118; 701/119; 701/209; 340/905

(58) Field of Search ..... 701/117, 119, 701/207, 208, 209, 210, 118; 340/903, 905, 991, 993, 992, 990, 995, 901, 902, 904, 907

(56) References Cited

U.S. PATENT DOCUMENTS 5,428,544 * 6/1995 Shyu ..... 701/117
5,699,056 * 12/1997 Yoshida ..... 340/905
5,778,333 * 7/1998 Koizumi et al. ..... 701/212
5,864,305 * 1/1999 Rosenquist ..... 340/995
5,983,161 * 11/1999 Lemelson et al. ..... 701/301
6,046,671 * 4/2000 Shimoura et al. ..... 340/439
6,092,020 * 7/2000 Fastenrath et al. ..... 701/119
6,097,313 * 8/2000 Takahashi et al. ..... 340/905

* cited by examiner

*Primary Examiner*—Jacques H. Louis-Jacques
(74) *Attorney, Agent, or Firm*—Jacobson Holman, PLLC

(57) ABSTRACT

A method for collecting traffic information is described. The method includes a position information transmitting step of installing a position transmitting device at a starting point and an ending point of a link of entire road and transmitting position information of the link to probe vehicles. There is an information receiving/classifying/searching step of receiving a transmission signal of a corresponding position while traveling on a road, and continuously classifying and searching the intensity of the signal and the position information of the link. The method also includes a travel information transmitting step of detecting the position of the probe vehicles and the starting point and the ending point of the link according to the result of searching, computing a time, a distance and a speed required for traveling the link on the basis of the detected information, and transmitting the same. A traffic information managing step of receiving and systematically storing the travel information of the probe vehicles is included and a step of computing a representative value for the travel information of each link, and recognizing and managing the traffic flow information on the entire road processes the information. An apparatus is provided to perform the method.

10 Claims, 11 Drawing Sheets

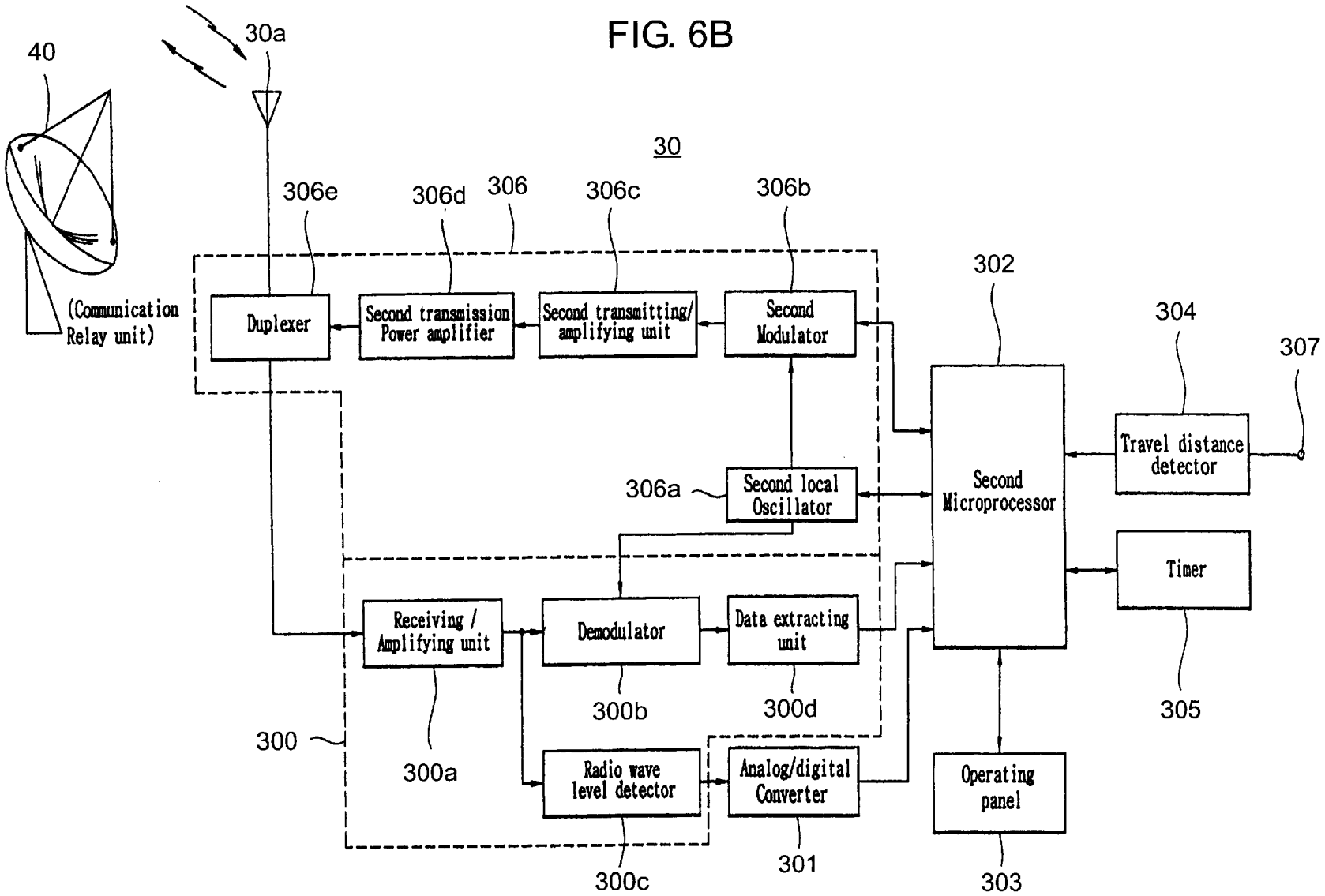
FIG. 6B
30
307
304
Travel distance detector
Timer
305
302
Second Microprocessor
Operating panel
303
306b
Second Modulator
Second local Oscillator
Data extracting unit
300d
Analog/digital Converter
301
306c
Second transmitting/ amplifying unit
306a
Demodulator
300b
Radio wave level detector
300c
306
306d
Second transmission Power amplifier
Receiving / Amplifying unit
300a
306e
Duplexer
300
30a
40
(Communication Relay unit)

METHOD AND APPARATUS FOR COLLECTING TRAFFIC INFORMATION

BACKGROUND OF THE INVENTION

1. Field of the Invention

The present invention relates to a traffic information system, and more particularly, to an apparatus and method for collecting traffic information on roads by which a time and a speed required for traveling a link of a road are detected and collected on a real time basis regardless of a location or an environment of the road. An average travel time and an average travel speed by links of the entire road are computed and managed by time zones, which are constantly provided to a driver so as to inform him of the extent of traffic congestion on roadways immediately and accurately.

2. Description of the Background Arts

Recently, according to industrial development, supply of vehicles has been explosively increased, which makes drivers to take more time and distance for driving. Also, as the road networks become complicated as they are expanding, there are high possibilities for the drivers to take an unfamiliar road to drive.

The rapid increase in the supply of the vehicles compared to the relatively little road leads to the severe traffic congestion in roads, causing an enormous damage to the national economy.

In order to reduce such a damage, it is necessary to quickly and accurately detect the extent of traffic congestion of the entire road and inform drivers of it, so that they can be dispersed to less congested roads or less crowded time zones in their use of roads. This would be quite advantageous in view that the limited road resource is effectively utilized without any investment.

Accordingly, it is desirable to collect traffic information on the entire road, so as to recommend to the drivers the fastest route to an intended destination before his starting or inform the drivers when they are unfortunately caught in heavily congested roads or in complicated downtown traffic networks.

Recently, there have been presented many traffic information collection systems for collecting traffic flow information on the entire road by time zones, for an effective management.

The traffic information collection systems are characterized in that positions of roads and facilities on the map are digitized and stored in a memory, position information on a vehicle mounting a terminal is collected and matched with links as digitized on the map of the memory, thereby guiding a travel time and a travel speed of each link of the entire road.

The traffic information collection systems mostly employ a global positioning system (GPS).

The GPS system in use for the traffic information collection system is a space-based satellite radio navigation system developed by the U.S. Department of Defense which includes an intentional error in transmission in order to prevent any military use by other countries.

According to this system, by receiving radio signals transmitted from at least three or four satellites among many GPS satellites having an atomic clock placed in the orbit, a distance to the satellite is obtained from the travel time of the radio signals and a speed measurement is available by using the Doppler effect.

As aforementioned, though the global positioning system (GPS) was initially developed for military use, as it was recognized to have a high utility value for civil vehicle means, the satellites started a service for civil use, by transmitting radio signals for measurement including the intentional range error.

By applying the global positioning system to the traffic information collection system, information on a vehicle operation, such as a distance to the destination and a time required, can be obtained.

Typically, the range error contained in the signal receiving from the GPS satellite is approximately in the range of 100 m to 2km.

FIGS. 1 and 2 are exemplary views of an apparatus for collecting traffic information by using the global positioning system in accordance with a conventional art.

The apparatus for collecting traffic information of the conventional art includes a plurality of GPS satellites 10 for transmitting GPS signals including time information; a GPS terminal for receiving, computing and transmitting the position information of the vehicle as transmitted from the GPS satellites 10; a vehicle 12 (termed as 'probe vehicle', hereinafter) mounting the GPS terminal; a communication relay unit 12 for relaying the signal transmitted from the GPS terminal 11; and a service center 108 for receiving the position signal of the relayed probe vehicle, and computing and managing an average travel time and travel speed of the probe vehicle 12.

As shown in FIG. 2, the GPS terminal 11 for computing the position information on the basis of the radio waves as transmitted from the GPS satellites 10 and transmitting the same to the communication relay unit 106 includes a GPS receiver 101 for receiving the GPS signal having the position information on the vehicle and the time information through an antenna 100 from the plurality of GPS satellites 10 and computing the position information of the probe vehicle 12; an operating panel 103 for selecting and inputting corresponding functions; a CPU for analyzing history of the position information periodically transmitted from the GPS receiver 101, to correct a position measurement error, and controlling the overall operation of the system; a wireless communication module 104 for modulating the position information on the probe vehicle for which the position error was corrected, and transmitting the same through the antenna 105.

The GPS receiver 101 of the GPS terminal 11 includes a frequency down converter 101*a* for frequency down converting the plurality of GPS signals in the different range of a few GHz(substantially 1~2 GHz)as received through the antenna to baseband signals; a GPS tuner 101*b* for extracting only a GPS signal corresponding to the current position of the vehicle from the frequency down converted baseband signals; a position operation unit 101*c* for computing an absolute coordinate of latitude, longitude, altitude and a standard time with the extracted GPS signal and outputting current position information on the probe vehicle 12 to the CPU 102.

The wireless communication module 104 of the GPS terminal 11 includes a local oscillator 104*b* for generating an oscillation frequency under the control of the CPU 102; a modulator 104*a* for modulating the position information of the probe vehicle 12 of which position error was corrected by the CPU; a transmitting/amplifying unit 104*c* for amplifying the modulated signal to a sufficient amplitude; and a transmission power amplifier 104*d* for power-amplifying the amplified transmission signal to a sufficient intensity and transmitting the same through the antenna 105.

As shown in FIG. 2, the service center 108 for receiving the position information on the probe vehicle 12 from the GPS terminal 11 and computing and managing the average travel time and travel speed of the probe vehicle 12 includes a communication server 108*a* for receiving the transmission signal of the GPS terminal 11 being relayed through the communication relay unit 106, and extracting the position information on the probe vehicle 12; a map server 108*b* for digitizing the extracted position information, and mapping it with the link on the electronic map to detect a travel time and a travel speed in the link; and a database server 108*c* for systematically managing the data related to the travel time and the travel speed of each link that was collected by operating the probe vehicle 12 from the map server 108*b*.

FIG. 3 is a signal flow chart illustrating a method for collecting traffic information of FIG. 2 wherein, when the probe vehicle is moving, the GPS signals transmitted from the plurality of the GPS satellites 10 are received by the GPS terminal 11 mounted in the probe vehicle 12 to compute the position of the probe vehicle and transmit it, and the service center 108 collects the transmitted position information on the probe vehicle 12 through the communication relay unit 106 to analyze the traffic flow information on the road, to thereby systematically store and manage it.

The operation of the apparatus for collecting traffic information using the global positioning system constructed as described above in accordance with the conventional art will now be explained in detail.

In the state that the GPS terminal 11 of the apparatus for collecting traffic information adapting the global positioning system is actuated by the operation of function keys of the operating panel 103 (stage: ST10), when the probe vehicle 12 starts moving (stage: ST11), the CPU 102 actuates the GPS receiver 101 and the wireless communication module 104.

Then, the GPS receiver 101 receives the radio waves from the plurality of GPS satellites 10 placed in the orbit and computes the position of the probe vehicle 12.

In other words, the plurality of GPS satellites placed in the orbit, that is, for example, 20 GPS satellites 10, transmits the GPS radio waves having the position information on the probe vehicle 12 and the time information.

As shown in FIG. 2, the GPS radio waves transmitted from the plurality of GPS satellites 10 are received by the GPS receiver 101 of the GPS terminal 11 mounted in the probe vehicle 12 to be processed.

As shown in FIGS. 1 and 2, the GPS receiver 101 of the GPS terminal 11 mounted in the probe vehicle 12 receives the radio waves from at least three or four GPS satellites 10 (preferably four GPS satellites) among many GPS satellites placed in the orbit through a radio wave receiving unit such as, for example, an antenna 100 (stage: ST12) and supplies the same to the frequency down converter 101*a*.

The frequency down converter 101*a* frequency down converts the received GPS radio waves in the range of a few GHz to baseband signals and then provides them to the GPS tuner 101*b*.

The GPS tuner 101*b* extracts a baseband signal that is the most suitable to its own position among the baseband signals for each GPS signal inputted through the frequency down converter 101*a*, and provides it to the position operation unit 101*c*.

The position operation unit 101*c* computes an absolute coordinate of the probe vehicle 12 on the basis of each baseband signal tuned and inputted by the GPS tuner 101*b*, that is, on the basis of the latitude, the longitude, the altitude and a standard time (stage: ST13), and provides it to the CPU 102 (to be described).

As aforementioned, the GPS signals transmitted from the plurality of satellites 10 include information on time as transmitted from the satellites.

The travel time taken for each of the radio waves to reach the probe vehicle 12 from each of the plurality of the GPS satellites is different to each other due to the difference in the distances between the probe vehicle 12 and each of the GPS satellites 10. In this respect, by using the travel time of each GPS signal from the GPS satellites to a specific probe vehicle 12 over a reference coordinate, the absolute coordinate value for the specific probe vehicle 12 can be obtained.

Accordingly, the CPU 102 corrects the error of the position information on the probe vehicle 12 inputted after being periodically and continuously computed by the position operation unit 101*c* of the GPS receiver 101, controls the local oscillator 104*b* of the wireless communication module 104 so as to transmit the corrected position information signal to the public network with very short cycle, i.e., 1 second cycle, and provides the position information signal to the modulator 104*a* of the wireless communication module 104.

The position information signal of the probe vehicle 12 corrected and outputted from the CPU 102 is mixed with the oscillation frequency of the local oscillator 104*b* in the modulator 104*a*, and amplified to a sufficient amplitude by the transmitting/amplifying unit 104*c* of the wireless communication module 104, and then provided to the transmission power amplifier 104*d*.

The transmission power amplifier 104*d* of the wireless communication module 104 power-amplifies the position information signal inputted after being frequency-modulated in very short cycle to a sufficient intensity, and transmits the same to the public network through the antenna 105 (stage: ST14).

The signal transmitted from the GPS terminal 11 of the probe vehicle 12 is received by the service center 108 through the communication relay unit 106 to be processed.

The service center 108 includes the communication server 108*a*, the map server 108*b* and the database server 108*c*.

The communication server 108*a* of the service center receives the transmission signal of the probe vehicle 12 relayed to the public network through the communication relay unit 106 through the antenna 107, and periodically extracts only the position information of the probe vehicle 12 from the received transmission signal and supplies the same to the map server 108*b* (stage: ST15).

The map server 108*b* includes a compact disk player loading the CD ROM.

The compact disk ROM stores the positions of the roads and facilities on the map.

Accordingly, as the position information is inputted through a communication line, the map server 108*b* loads the electronic map recorded on its own recording medium such as the compact disk to read it.

The position information on the probe vehicle 12 as extracted and inputted is map-matched with a starting point and an ending point of each link on the electronic map, so that time and speed required for the probe vehicle 12 to travel in each link are periodically computed (stage: ST16).

The data related to the travel time and travel speed of the probe vehicle 12 computed by links in the map server 108*b* is periodically provided to the database server 108*c* through the communication line.

The database server 108*c* systematically stores and analyzes the data related to the travel time and the travel speed in each link that is collected over the operation of the probe vehicle 12 from the map server 108*b* (stage: ST17), to compute an average travel time and an average travel speed in the link (stage: ST18).

In that manner, the average travel time and speed in the link are computed and managed by time zones, and transmitted to the vehicle mounting the car navigation system, so that the traffic flow on the roads can be notified, and the fastest route to the destination can be recommended to the driver before starting traveling.

As to the apparatus for collecting traffic information using the global positioning system in accordance with the conventional art as described above, it is noted that the radio waves transmitted from at least three GPS satellites among the plurality of GPS satellites placed in the orbit is received by the probe vehicle to thereby computes the position of the vehicle, and computed position information on the probe vehicle is wirelessly collected by the map server of the service center and map-matched with the starting point and the ending point of the link on its own electronic map, thereby computing and managing the average time and speed taken for traveling in each link of roads.

However, the apparatus for collecting traffic information using the global positioning system in accordance with the conventional art has disadvantages in that since the GPS satellite signal intentionally includes an error, in case that the position of the vehicle is sensed by using the GPS terminal, the position error is extensively generated in the range of 100 m to 2 Km, making it difficult to accurately map-match with the starting point and the ending point of the link.

Also, in an area where there is a tunnel, or in a mountainous area, or in the downtown area where there are many tall buildings, since less than four satellites are available for simultaneously receiving the radio waves to the probe vehicle, the position error for the probe vehicle is so broad-ranged, and thus, its accurate position of the vehicle is hardly detected.

In addition, besides the problem caused by the GPS signal error, another error is generated with map-matching the starting point and the ending point of the link because of the communication cycle in transmitting the position information on the probe vehicle to the service center. Also, in order to reduce this error, the position information on the probe vehicle is required to be transmitted to the service center at very short intervals, which disadvantageously causes a problem in that the expense for communication is much increased.

Furthermore, use of a differential GPS may be considered as one method for reducing the measurement error of the probe vehicle with respect to the GPS radio waves transmitted from the plurality of satellites, which, however, also increases the expense.

SUMMARY OF THE INVENTION

Therefore, an object of the present invention is to provide an apparatus and method which is capable of accurately computing an average time and an average speed taken for traveling in a links collecting a starting point and an ending point of each link on a real-time basis for the entire road without mapmatching them with an electronic map.

Another object of the present invention is to provide an apparatus and method for collecting traffic information which is capable of accurately receiving and transmitting position information on a probe vehicle without any error even in an area that could hardly receive the signals from GPS satellite.

Still another object of the present invention is to provide an apparatus and method for collecting traffic information in which a position transmitting device installed on roadsides, a radio frequency terminal unit mounted in a probe vehicle and a service center are connected to each other by wireless communication network, thereby accurately collecting and recognizing a travel time and a travel speed by links of each road by time zones.

Yet another object of the present invention is to provide an apparatus for collecting traffic information which is capable of minimizing the number of communication between a service center and a radio frequency terminal unit mounted in a probe vehicle to thereby reducing the expense for communication, and its method.

To achieve these and other advantages and in accordance with the purposes of the present invention, as embodied and broadly described herein, there is provided a method for collecting traffic information including: a position information transmitting step of installing position transmitting devices at starting points and ending points of the links of entire road and transmitting position information of the link with suitable signal intensity to probe vehicles; an information receiving/classifying/searching step of receiving a transmission signal of a corresponding position while traveling on a road, and continuously classifying and searching the intensity of the signal and the position information of the link; a travel information transmitting step of detecting the position of the probe vehicles and the starting point and the ending point of the link according to the result of searching, computing a time, a distance and a speed required for traveling the link on the basis of the detected information and transmitting the same; and a traffic information managing step of receiving and systematically storing the travel information of the probe vehicles, computing a representative value for the travel information by links, and detecting/managing the traffic flow information for the entire road.

In order to achieve the aforementioned objects, there is also provided a method for collecting traffic information including a link information transmitting step of installing position transmitting devices at starting points and ending points of the links of the entire road, and transmitting position information of the link, distance information between the starting point and the ending point, and time information with suitable signal intensity to probe vehicles; an information receiving/classifying step of receiving a transmission of a corresponding position while traveling on the road, and classifying the position information of the link, the distance information, the time information and the intensity of the signal; a travel information transmitting step of obtaining a travel time, a travel distance and a travel speed in the link on the basis of the classified time information and distance information obtained in traveling from the starting point to the ending point of the link as detected, and transmitting the same; and a traffic information management step of receiving and systematically storing the travel information of the probe vehicle by links, computing a representative value for the travel information of each link of the probe vehicles, and detecting and managing traffic flow information for the entire road.

In order to achieve the aforementioned objects, there is also provided an apparatus for collecting traffic information including: position transmitting devices installed at starting points and ending points of the links of the entire road and transmitting position information of a suitable intensity to a probe vehicle traveling in the link; a radio frequency terminal unit mounted in the probe vehicle traveling in the link for receiving position information, detecting a travel distance and a travel time required for the probe vehicle to travel in the link according to the received position information, and computing a travel speed to transmit it to a public network; a communication relay unit for receiving the travel information by links collected by the probe vehicle while traveling in the link and relaying them; and a service center for receiving and systematically storing the travel information by links relayed through the communication relay unit, obtaining average values of the travel distance, the travel time and the travel speed over the stored travel information by links, thereby managing the traffic flow information for the entire road.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 6A, 6B and 6C are detailed block diagrams of the apparatus for collecting traffic information of FIG. 5, in which FIG. 6A is a block diagram of the position transmitting device installed at key points on roadsides for transmitting position information;

FIG. 6B is a block diagram of the radio frequency terminal unit mounted in the probe vehicle for receiving the information from the position transmitting device; and FIG. 6C is a block diagram of the service center for collecting and systematically managing traffic information transmitted through a communication relay unit;

FIGS. 7A, 7B and 7C are signal flow charts of the process of collecting traffic information, in which FIG. 7A is a signal flow chart of an operation of the position transmitting device of FIG. 6A;

FIG. 7B is a signal flow chart of an operation of the radio frequency terminal unit of FIG. 6B for receiving the position information from the position transmitting device of FIG. 6A and computing it; and FIG. 7C is a signal flow chart of an operation of the service center of FIG. 6C for collecting the traffic information transmitted from the radio frequency terminal unit of FIG. 6B and systematically managing it.

DETAILED DESCRIPTION OF THE PREFERRED EMBODIMENTS

Figure 1:
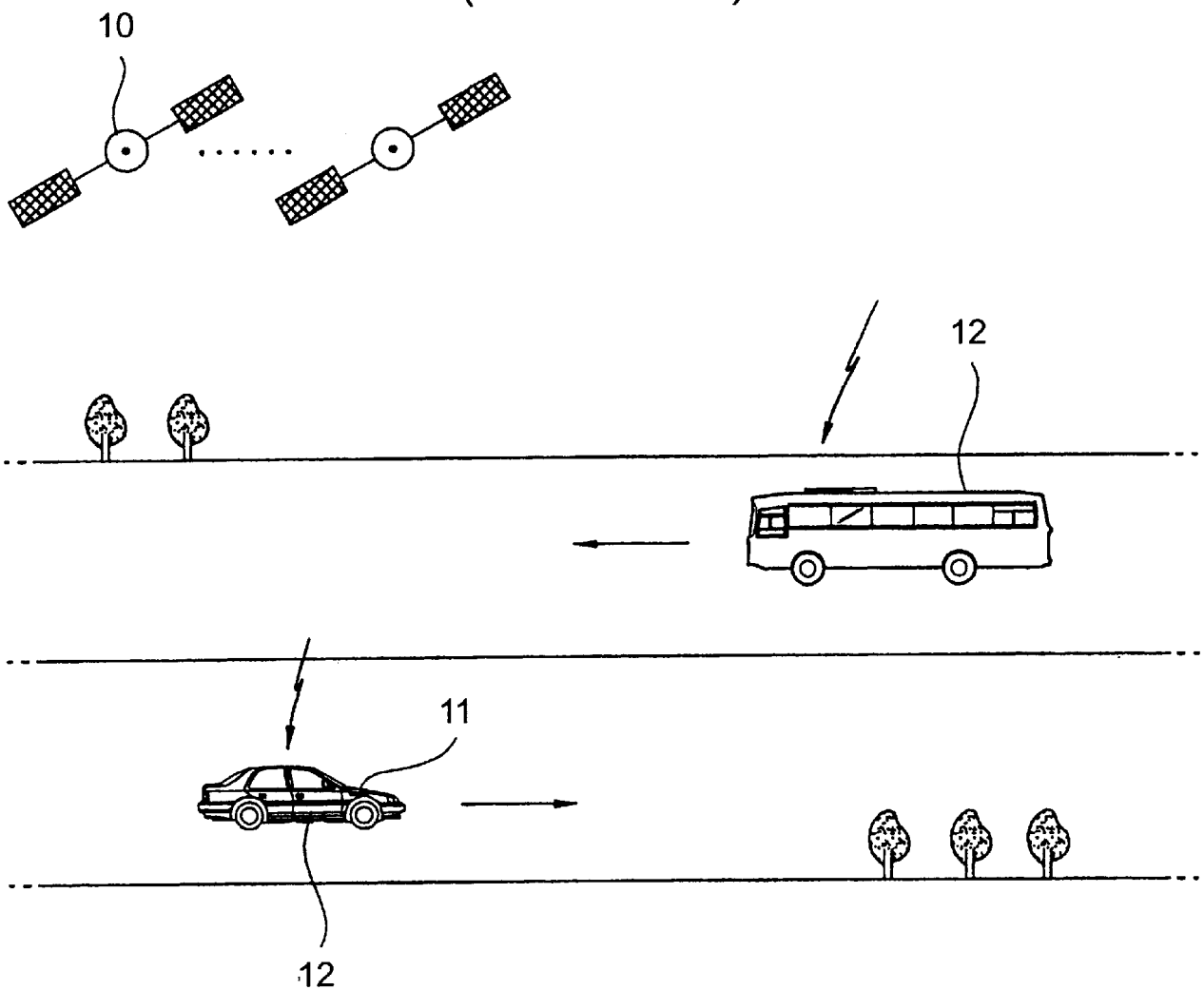
FIG. 1 (PRIOR ART)
FIG. 1 is a conceptional view of an apparatus for collecting traffic information on roads using a global positioning system in accordance with a conventional art.
Figure 2:
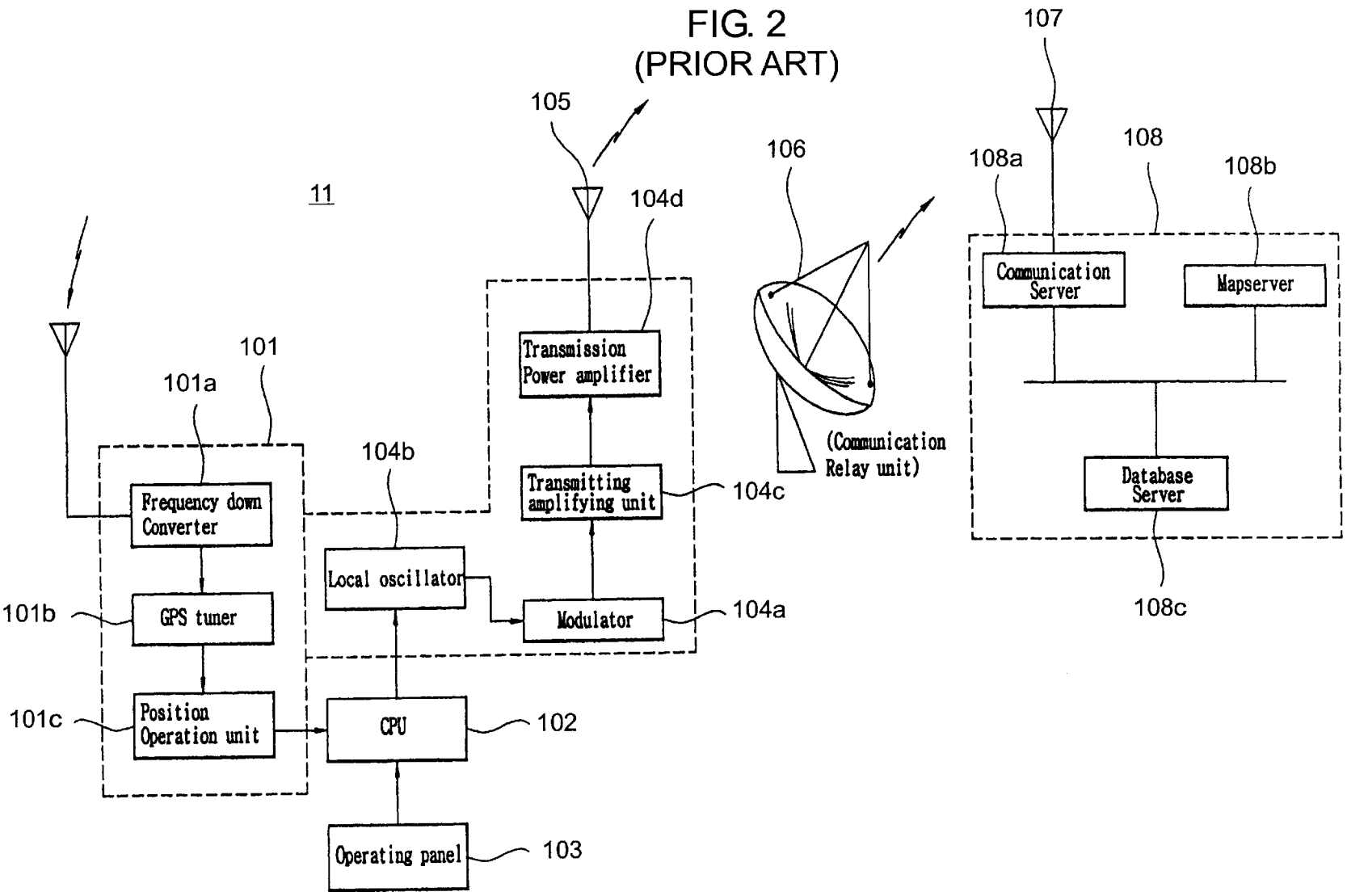
FIG. 2 (PRIOR ART)
FIG. 2 is a detailed block diagram of a service center for collecting and systematically managing traffic information and a GPS terminal mounted in a vehicle in accordance with the conventional art.
Figure 3:
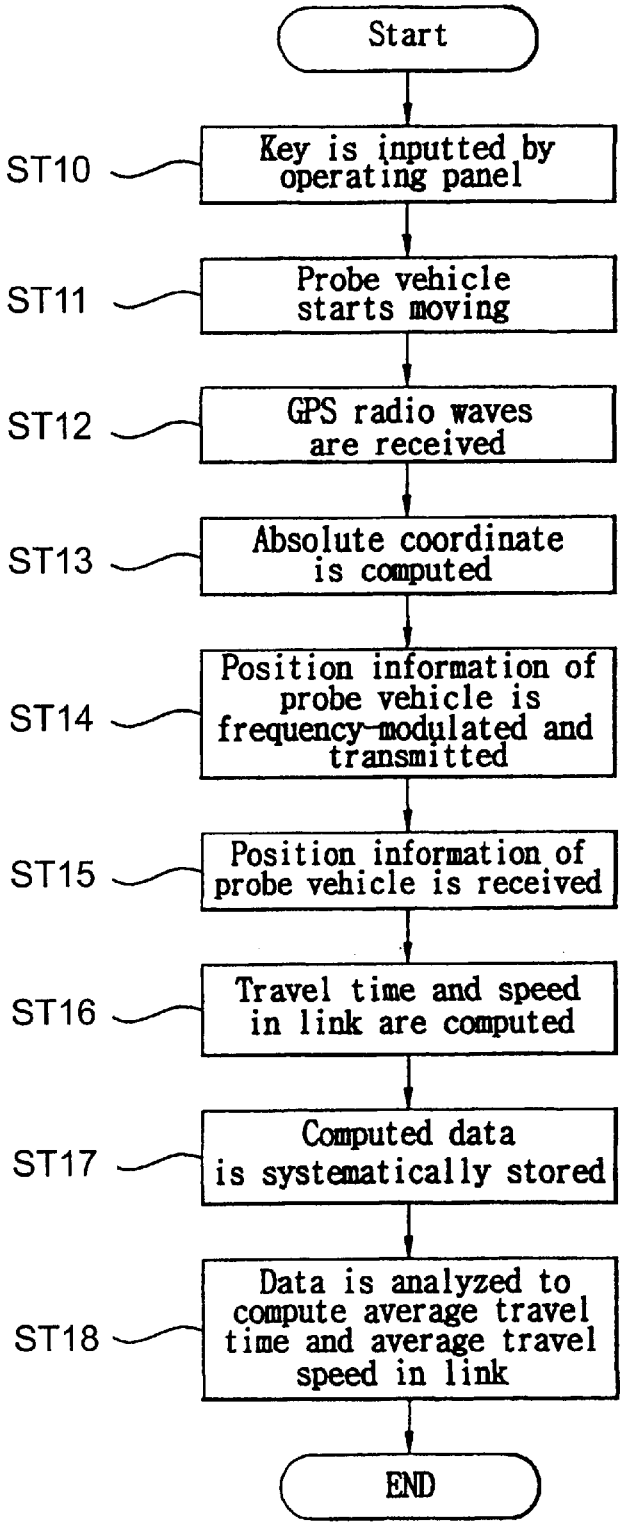
FIG. 3 (PRIOR ART)
FIG. 3 is a signal flow chart of a process of collecting traffic information of FIG. 2 in accordance with the conventional art.

Reference will now be made in detail to the preferred embodiments of the present invention, examples of which are illustrated in the accompanying drawings.

The technique of the present invention may be adapted to various traffic information system directed to collecting traffic flow information on the entire road for service to drivers of vehicles traveling on roads.

Accordingly, FIGS. 4 through 7 are based on an exemplary traffic information system which is capable of detecting and collecting traffic flow information on roads by transmitting and receiving RF wave signals in accordance with the present invention.

Regarding the drawings for explanation of the present invention, the same constructive elements are given the same reference numerals.

Figure 4:
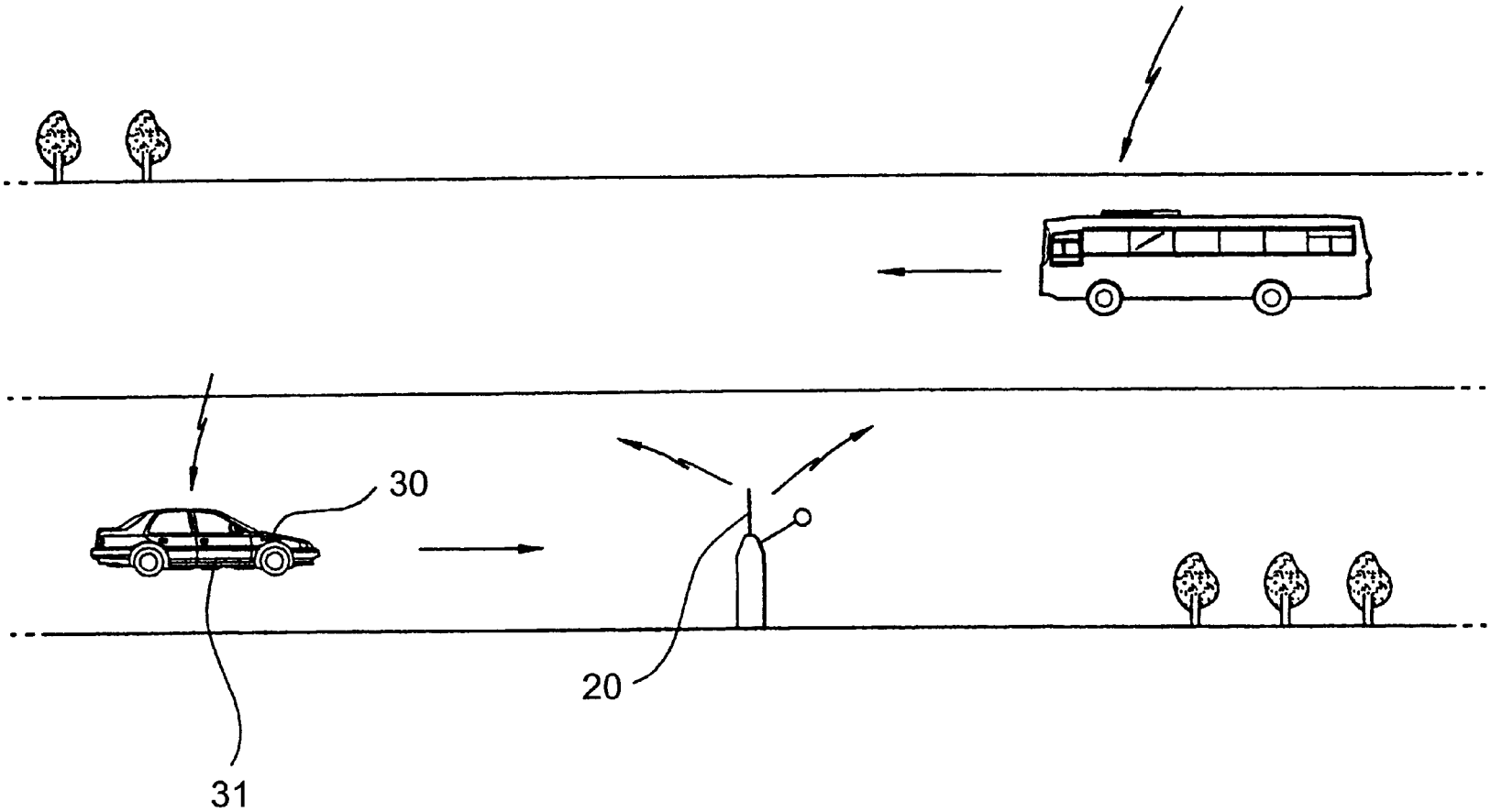
FIG. 4 is a conceptional view of an apparatus for collecting traffic information in accordance with the present invention.
Figure 5:
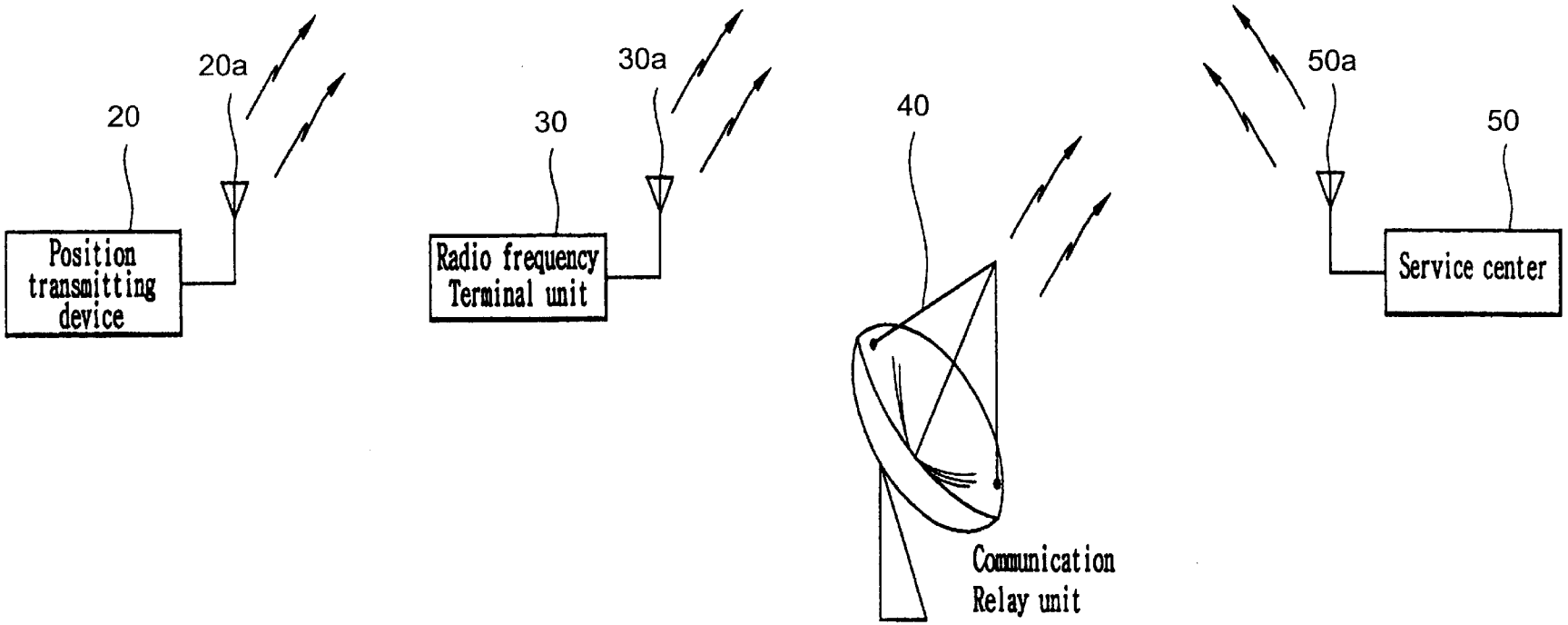
FIG. 5 is a schematic block diagram for showing a process of collecting traffic information through a position transmitting device installed in a roadside, a radio frequency terminal unit mounted in the probe vehicle and a service center in accordance with the present invention.

FIG. 4 is a conceptional view of an apparatus for collecting traffic information in accordance with the present invention, and FIG. 5 is a schematic block diagram for showing a process of collecting traffic information through a position transmitting device installed in a roadside, a radio frequency terminal unit mounted in the probe vehicle and a service center in accordance with the present invention.

Figure 6A:
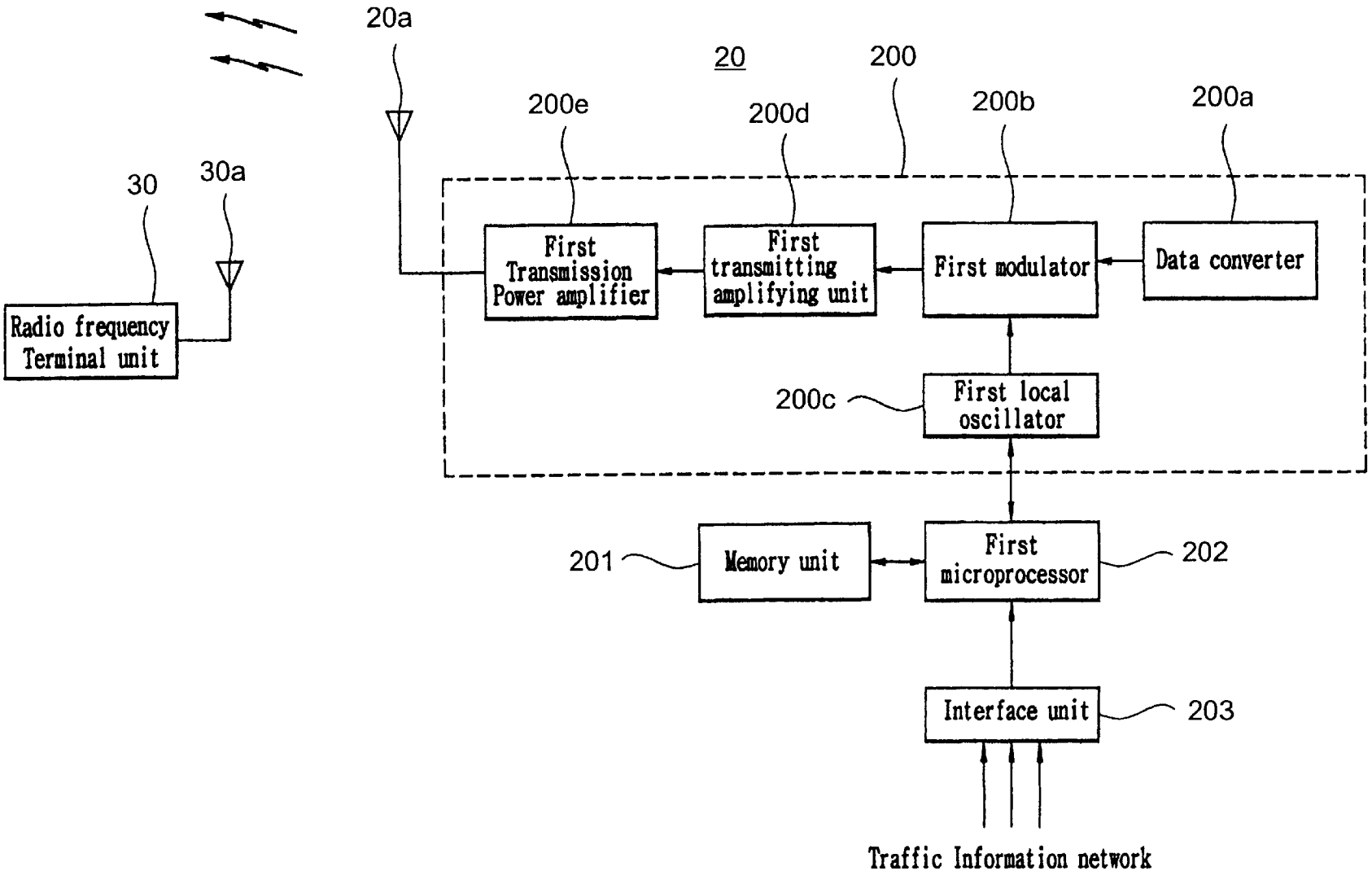

The apparatus for collecting traffic information in accordance with the present invention includes: a plurality of position transmitting devices 20 installed at starting points and ending points of the links of the entire road, for wirelessly transmitting its own identification (ID) number or an absolute coordinate value for its position with a proper signal intensity through an antenna 20*a*; a radio frequency terminal unit 30 mounted in a probe vehicle traveling in the link of a road, for receiving the signal through the antenna 30*a* from the position transmitting device 20, detecting a travel distance and a travel time required for the probe vehicle 30 to travel in the link from the received signal and computing a travel speed to transmit the same to a public network through the antenna 30*a*; a communication relay unit 40 for receiving the travel information by links as collected by the radio frequency terminal unit 30 while the probe vehicle 31 is traveling from the public network, and relaying the same; and a service center 50 for receiving the relayed travel information by links from the radio frequency terminal unit 30 through the antenna 50*a*, and managing traffic flow information for the entire road for service As shown in FIG. 6A, each of the plurality of position transmitting devices 20 respectively installed at the starting points and the ending points of the links for the entire road, includes an interface unit 203 for receiving the position information and traffic information for service to the probe vehicle 31 from a traffic information communication network and signal processing them; a memory unit 201 for storing the identification number of a corresponding position transmitting device 20 installed at the starting point and the ending point of a link or an absolute coordinate value for the position of the corresponding position transmitting device 20 and the traffic information through the interface unit 203 as code values and storing them; a first transmission module for modulating the position information and the traffic information stored in the memory unit 201 and transmitting them to the probe vehicle 31 through the antenna 20*a*; and a first microprocessor 202 for coding the position information of the link and the traffic information of the interface unit 203 to provide them to the memory unit 201, and controlling the overall operation of the first transmission module 200 when transmitting the position information.

The first transmission module 200 includes: a data converter 200*a* for receiving the position information (the identification number or the absolute coordinate value) of the link coded and stored in the memory unit 201 from the first microprocessor 202 and converting it to a bit stream for outputting; a first local oscillator 200*c* for generating an oscillation frequency under the control of the first microprocessor 202; a first modulator 200*b* for modulating the bit stream converted and inputted from the data converter 200*a* using the first local oscillator 200*c*; a first transmitting/amplifying unit 200*d* for amplifying the modulated signal to a sufficient level; and a first transmission power amplifier 200*e* for power-amplifying the amplified signal to a sufficient intensity and transmitting the same to the public network through the antenna 20*a*.

Figure 6C:
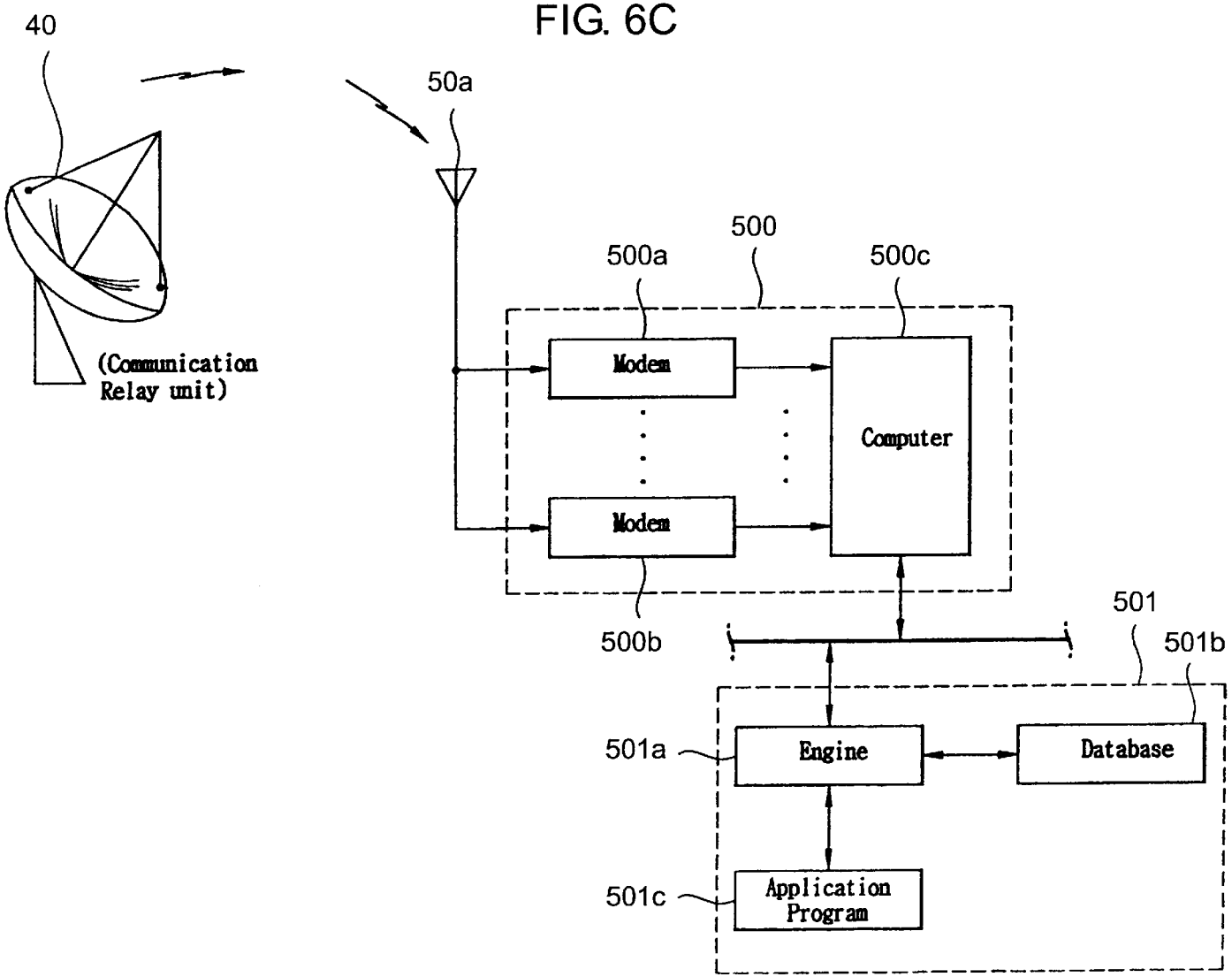

As shown in FIG. 6C, the radio frequency terminal unit 30 of the probe vehicle 31 includes: a receiving module 300 for receiving the modulated signal from a corresponding position transmitting device 20 through the antenna 30*a*, classifying and detecting the position information and the intensity of the received signal; an analog-to-digital converter 301 for digitizing the intensity of the signal as classified by the receiving module 300; a travel distance detector 304 for receiving pulses generated according to the travel distance of the probe vehicle 31 through an input terminal 307 and computing them to output; a timer 305 for periodically counting time when the probe vehicle 31 is traveling on the road, so as to detect a travel time; a second microprocessor 302 computing and recognizing a travel time, a travel distance and a travel speed in the link on the basis of the position information classified by the receiving module 300, the digital value according to the intensity of the signal and the count values of the travel distance detector 304 and the timer 305; a second transmission module 306 for modulating the information on the travel time, the travel distance and the travel speed in the link as computed by the second microprocessor 302, and transmitting the same to the communication relay unit 40 through the antenna 30*a*, and an operating panel 303 for inputting function keys to the second microprocessor 302.

The receiving module 300 includes: a receiving/amplifying unit 300*a* for receiving the signal through the antenna 30*a* from the first transmission module 200 of the position transmitting device 20 and amplifying it; a demodulator 300*b* mixing the position information of the amplified signal from the receiving/amplifying unit with the oscillation frequency to demodulate it to an original signal; a radio wave level detector 300*c* for detecting a level of the receiving signal as amplified by the receiving/amplifying unit 300*a* and providing it to the analog-to-digital converter 301; and a data extracting unit 300*d* for extracting the position information of the link from the demodulated signal and providing the extracted information to the second microprocessor 302.

The second transmission module 306 includes: a second local oscillator 306*a* for generating an oscillation frequency under the control of the second microprocessor 302 and providing it to the demodulator 300*b*; a second modulator 306*b* for mixing the travel information inputted from the second microprocessor 302 with the oscillation frequency of the second local oscillator 306*a* and outputting it; a second transmitting/amplifying unit 306*c* for amplifying the modulated signal to a predetermined level and outputting it; a second transmission power amplifier 306*d* for power-amplifying the amplified signal to a sufficient intensity and outputting it; and a duplexer 306*e* for separating the transmission signal of the second transmission power amplifier 306*d* and the receiving signal in transmitting and receiving.

As shown in FIG. 6C, the service center 50 includes: a communication server 500 for receiving the travel information of each link as relayed from the communication relay unit 40 through the antenna 50*a* and a plurality of modems 500*a* and 500*b*, detecting whether there is an error by means of a computer 500*c*, and outputting it to the transmission line; and a database server 501 for receiving the travel information by links from the transmission line, systematically storing in a database 501*b* through the engine 501*a*, analyzing the stored travel information by links with an application program 501*c*, and obtaining and managing average values of the travel distance, the travel time and the travel speed for the travel information by links.

Figure 7A:
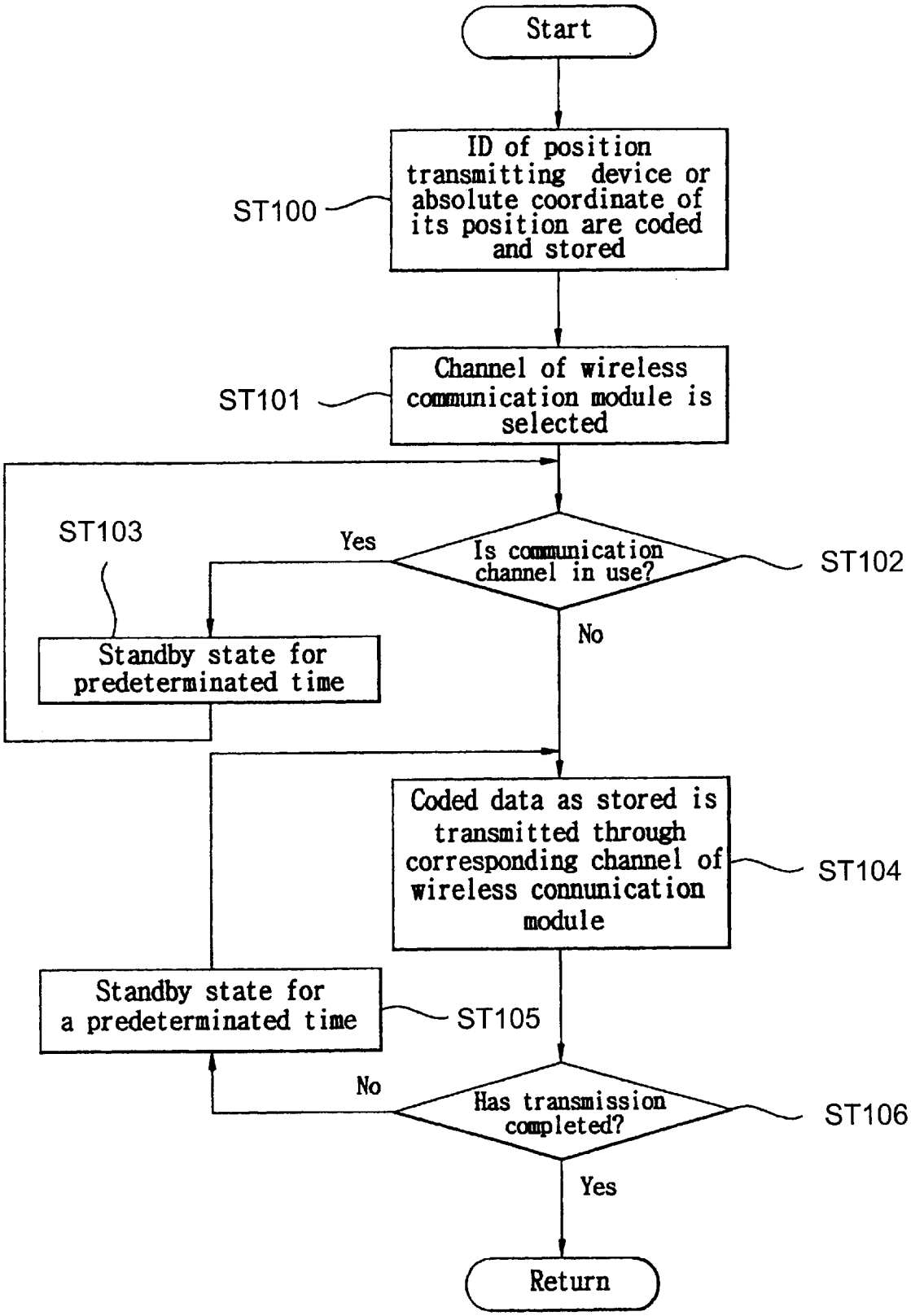
Figure 7B:
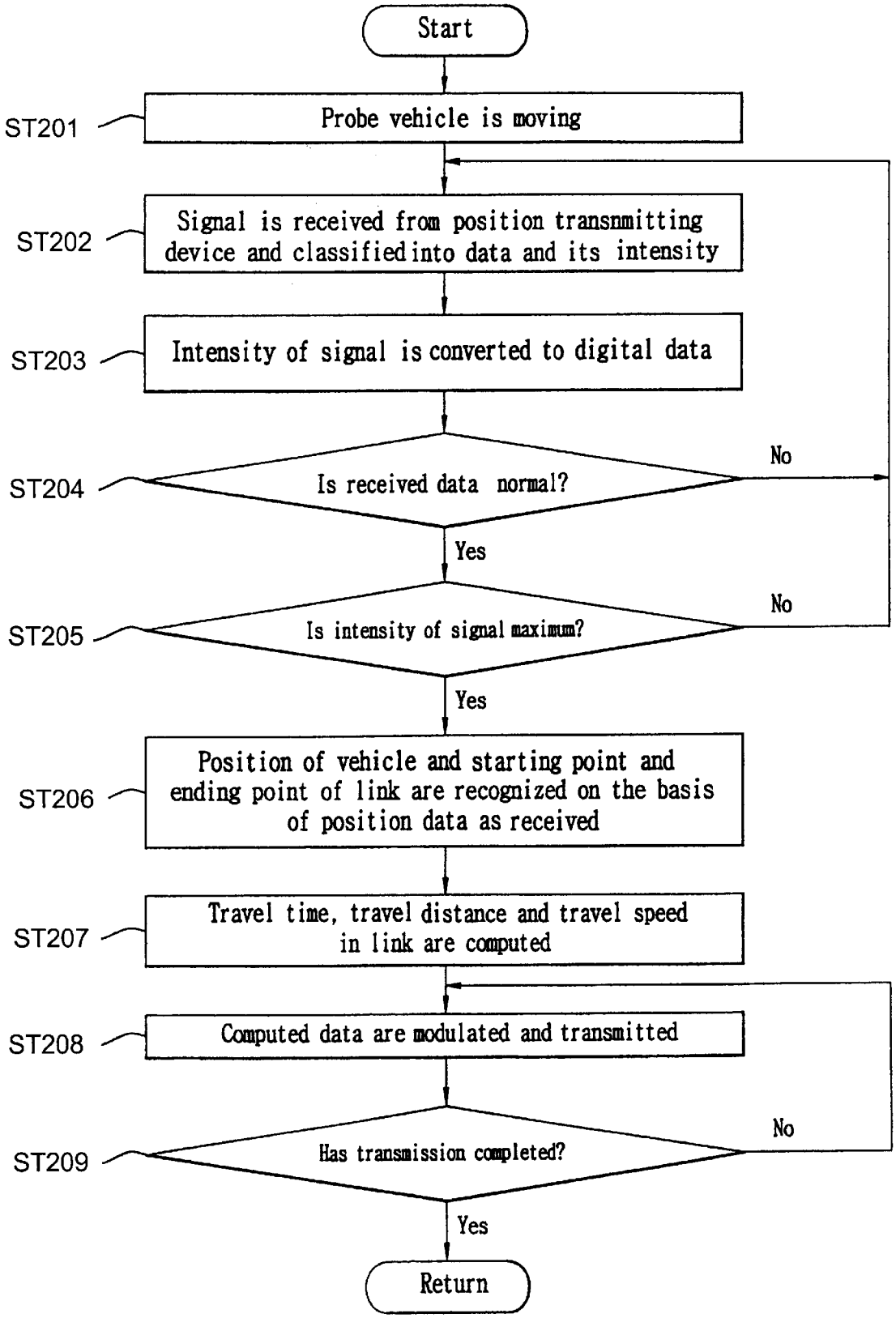
Figure 7C:
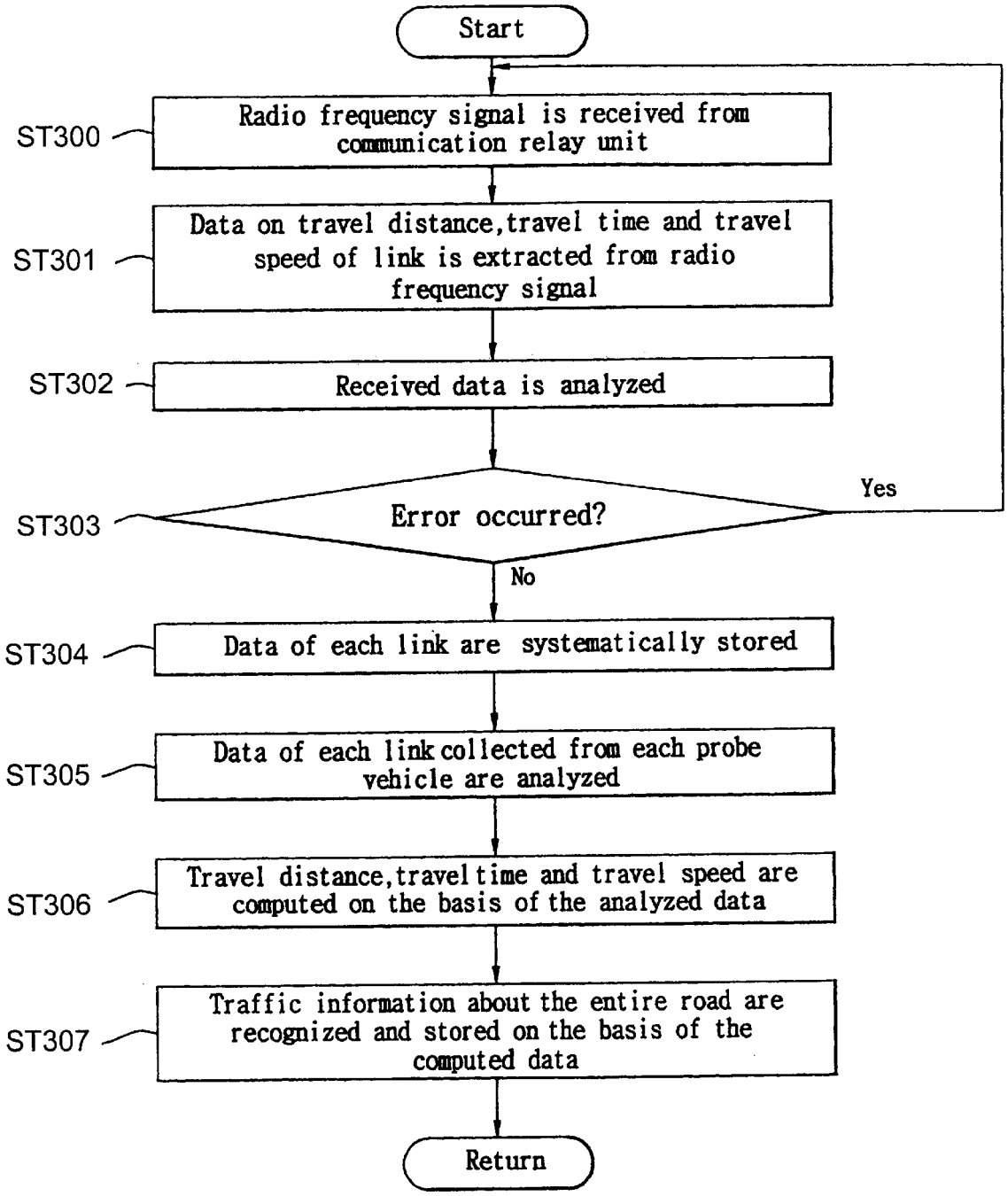

FIG. 7A is a signal flow chart of an operation of the position transmitting device of FIG. 6A in which the position information, that is, the starting point and the ending point of the link, is modulated and transmitted to the probe vehicle 31 traveling in the link of a road, FIG. 7B is a signal flow chart of an operation of the radio frequency terminal unit of FIG. 6B in which the travel time, the travel distance and the travel speed required for the probe vehicle 31 to travel in the link are computed on the basis of the signal transmitted from the position transmitting device 20 and transmitted to the service center 50 through the communication relay unit 40, and FIG. 7C is a signal flow chart of an operation of the service center 50 of FIG. 6C in which the travel information collected by the radio frequency terminal unit 30 is received through the communication relay unit 40 for recognizing the flow of the traffic on the roads for a systematic management.

The operation of the apparatus for collecting traffic information in accordance with the present invention constructed as described above will now be explained with reference to FIGS. 4 through 7.

First, referring to FIG. 4, the plurality of position transmitting devices 20 as shown in FIGS. 5 and 6A installed at the starting points and ending points of the links over the entire road are actuated.

Accordingly, the interface unit 203 of FIG. 6A receives position information of a corresponding position transmitting device 20 installed at the starting point and the ending point of the link, that is, its own identification (ID) number or the value of the absolute coordinate (a latitude, a longitude and an altitude) for the position of the corresponding position transmitting device 20, and the traffic information for service to the probe vehicle 31 or general vehicles from the traffic information network, and provides the same to the first microprocessor 202.

Then, the first microprocessor 202 codes the inputted traffic information and the position information and stores it in a data recording medium such as a non-volatile memory unit 201 (stage: ST100).

In this respect, the position information may be received from the traffic information network, or may be stored in the data recording medium such as the non-volatile memory unit 201 by operating a key input unit such as its own operating panel as required.

The reason why the position transmitting device 20 receives the traffic information from the traffic information network is to transmit traffic information to a vehicle mounting a car navigation system, to thereby recommend the fastest route to its destination before starting driving and guide drive to a less congested road.

In a state that the position information and the traffic information are stored after being coded, the first microprocessor 202 searches channels of the first transmission module 200 to transmit the position information through the communication channel (stage: ST101).

Upon judging whether the searched channel is in use or not (stage: ST102), if the currently searched channel is in use, that is, in case that the channel is currently transmitting the position information (its own identification number or the absolute coordinate value for its position) or the traffic information, the first microprocessor 202 is in standby state until the communication channel becomes idle, that is, until the transmission of the position information or the traffic information is completed (stage: ST103).

The reason for this is that the position transmitting device 20 transmits the position information or the traffic information stored in the non-volatile memory unit 201 periodically and repeatedly. As the transmission content of one cycle is completed, the same transmission content is transmitted again. In this respect, in order to judge whether the transmission content of one cycle is completely transmitted, the first microprocessor 202 searches the communication channel periodically.

If the communication channel is idle at stage ST102, the first microprocessor 202 controls the first local oscillator 200*c* of the first transmission module 200 to transmit the position information, and reads out the position information stored in the non-volatile memory unit 201 to provide it to the data converter 200*a*.

The position information outputted from the first microprocessor 202 is converted to a bit stream by the data converter 200*a* and then mixed with the oscillation frequency of the first local oscillator 200*c* in the first modulator 200*b*, which is then amplified to a sufficient amplitude by the first transmitting/amplifying unit 200*d* of the first transmission module 200 and supplied to the first transmission power amplifier 200*e*.

The first transmission power amplifier 200*e* power-amplifies the modulated transmission signal to a sufficient intensity and transmits it to roads through the antenna 20*a* (stage: ST104), and is in a standby state for a predetermined time until the transmission is completed (stage: ST105).

Thereafter, upon judging whether the transmission was completed or not, if the transmission is going on, the steps after the stage ST104 are repeatedly performed, while if the transmission was finished, the same position information is continuously transmitted through the next communication channel. The transmission signal transmitted from the antenna 20*a* of the position transmitting device 20 is received by the radio frequency terminal unit 30 of a corresponding probe vehicle 31 traveling on the road where the position transmitting device 20 installed, that is, from the starting point to the ending point of the link on the road.

Referring to FIGS. 5 and 6*b*, the radio frequency terminal unit 30 of the probe vehicle 31 traveling in the link of the road where the position transmitting devices 20 are installed collects the transmission signal transmitted through the antenna 20*a* of the position transmitting device 20, that is, collects the radio waves of the respective position transmitting devices 20 while the probe vehicles 31 are moving in the link of the road so as to recognize the current position of the probe vehicle 31 and the starting point and the ending point of the link, and obtains the time required for traveling the link, the distance of the link and the travel speed in the link so as to transmit them to the service center 50 through the communication relay unit 40 (to be described).

The radio frequency unit 30 of the probe vehicle traveling in the link where the position transmitting device 20 is installed is constructed as shown in FIG. 6B.

First, in a state that the radio frequency terminal unit 30 is actuated, when the probe vehicle 31 is moving in the link of the road where the position transmitting device 20 is installed (stage: ST201), the antenna 30*a* of the radio frequency terminal unit 30 mounted in the probe vehicle 31 receives the transmission signal of the nearest position transmitting device, i.e., the one installed at the starting point of the link, among the transmission signals (radio frequency signals) of the plurality of the position transmitting devices respectively installed at the starting points and the ending points of the link over the entire road.

Noise of the received signal is filtered in the receiving/amplifying unit 300*a* of the receiving module 300 through the transmission/receiving separation unit such as the duplexer 306*a*. The signal is then amplified to a sufficient amplitude of a pre-set amplification level, and then shunted to the demodulator 300*d* and the radio wave level detector 300*c*.

The position information received from the receiving/amplifying unit, that is, the position information of the starting point or the ending point of the link is mixed with the oscillation frequency of the second local oscillator 306*a* of the second transmission module 306 by the demodulator 300*b* so as to be demodulated to its original information and then supplied to the data extracting unit 300*d*.

In this respect, the position information is the identification number of the position transmitting device installed at the starting point or the ending point of the link or the value of the absolute coordinate (the latitude, the longitude, the altitude) for the position of the position transmitting device, which will be expressed as a position information hereinafter.

The data extracting unit 300 extract information for service to the probe vehicle 31 i.e., the position information transmitted from the corresponding position transmitting devices device 20 and supplied to the second microprocessor 402.

The radio wave level detector 300*c* of the receiving module 300 detects the intensity of the receiving signal as amplified and inputted from the receiving/amplifying unit 300*a*, that is, the intensity of the radio wave of the position transmitting device 20 (stage: ST 202), and provides it to the analog-to-digital converter 301.

The analog/digital converter 301 converts the intensity of the inputted radio wave to numeric data (stage: ST203) and provides it to the second microprocessor 302. The amplitude of the receiving signal becomes greater as the probe vehicle 31 comes near the position transmitting device 20 installed in the starting point or the ending point of the link.

Accordingly, the second microprocessor 302 of the radio frequency terminal unit 30 continuously monitors the intensity of the signal of the position transmitting device 20 when the probe vehicle 31 is traveling in the link of the road.

When the intensity of the signal and the position information are inputted after being classified and detected through the receiving module 300, the second microprocessor 302 judges whether the position information inputted from the data extracting unit 300*b* are normal (stage: ST204), and judges the intensity value of the signal continuously detected and inputted from the analog-to-digital converter 301 (stage: ST205).

Upon the judgment at step ST204, if the position information is not normal or the intensity of the receiving signal is weak at the stage ST205, the probe vehicle 31 periodically collects the intensity of the signal and the position information of the link while it keeps driving.

The phenomenon that the received position information are not normal or the intensity of the received signal is weak are caused when the probe vehicle 31 is positioned between the position transmitting device 20 installed at the starting point of the link and the position transmitting device installed at the ending point of the link while it is moving.

In this case, since both signals transmitted from the two position transmitting device are received by the radio frequency terminal unit 30 of the corresponding probe vehicle 31, resultantly, the second microprocessor 302 of the radio frequency terminal unit 30 judges the received position information (the mixed information of the position information of the starting point and the position information of the ending point) as an abnormal one.

In this respect, since the probe vehicle is positioned in the middle of the two position transmitting devices, not nearing either one of them, the intensity of the signal is unavoidably detected to be weak.

In the case where the probe vehicle 31 is positioned between the two position transmitting devices 20 and thus the position information is detected to be abnormal or the signal intensity is weak, as mentioned above, the probe vehicle 31 keeps driving to collect and search the normal position information and the signal intensity.

Meanwhile, in case that the position information searched in the stage ST204 and ST205 is normal and the intensity of the receiving signal is at its maximum, that is, when the vehicle approaches the nearest position transmitting device 20, the current position of the probe vehicle 31 and the starting point or the ending point of the link are recognized by the position information transmitted from the corresponding position transmitting device, that is, the identification (ID) number of the position transmitting device 20, or by the absolute coordinate value (stage: ST206).

For example, as the probe vehicle 31 comes near the position transmitting device 20 installed at the starting point of the link while traveling, the second microprocessor 302 recognizes the current position of the probe vehicle 31 as the starting point of the link with the identification number transmitted from the corresponding position transmitting device 20 or its absolute coordinate value, and when the probe vehicle 31 passes the position transmitting device installed at the ending point of the link, the second microprocessor 302 recognizes the current position of the probe vehicle 31 as the ending point of the link with the identification number transmitted from the corresponding position transmitting device 20 or its absolute coordinate value.

After recognizing the starting point and the ending point of the link, the second microprocessor 302 computes the distance 'd' from the starting point to the ending point of the link, the time 't' and speed 'V' required for traveling from the starting point to the ending point of the link (stage: ST207).

The distance 'd' between the starting point and the ending point of the link is computed by counting the number of pulses transmitted in proportion to the travel distance by the travel distance detector 304. The time 't' required for traveling the link is detected by using an output value of the travel time detector generating pulses on a real-time basis such as the timer 305. The travel speed 'V' in the link is obtained on the basis of the travel time 't' and the travel distance 'd' of the link as detected.

In detail, as shown in FIG. 6B, the travel distance detector 304 such as the travel distance metric system counts the number of pulses inputted through the input terminal 307 whenever the wheels of the probe vehicle 31 is rotated by one time, and outputs it.

Then, on the basis of the position information on the starting point and the ending point of the link as recognized, the second microprocessor 302 computes the travel distance 'd', that is, the distance between the starting point and the ending point of the link, according to a proportional expression of the number of the pulses inputted from the travel distance detector 304 and the circumference of the wheel of the probe vehicle 31.

For instance, in case of a probe vehicle 31 that four pulses are outputted from the travel distance detector 304 when the wheel of the probe vehicle is rotated by one time, the travel distance 'd' is obtained by the following equation:

Travel distance 'd'=n×I×1/m=n×I×¼, wherein 'n' indicates the total number of the pulses for the distance that the probe vehicle traveled, 'I' indicates the circumference of the wheel of the probe vehicle 31, and 'm' indicates the number of pulses when the wheel of the vehicle is rotated by one time.

The travel speed 'V' can be obtained by dividing the travel distance 'd' by the travel time 't' obtained by the travel time detector 305.

Namely, travel speed 'V' =travel distance 'd'/ travel time 't'.

The information is periodically collected from the respective position transmitting devices 20 and the travel distance 'd', the travel time 't' and the travel speed 'V' in the link are computed, which are then transmitted through the communication relay unit 40 to the service center 50.

In order to transmit the information related to the travel distance 'd', the travel time 't' and the travel speed 'V' to the service center 50, the second local oscillator 306*a* and the duplexer 306*e* of the second transmission module 306 need to be controlled to be in a transmission mode, and the computed data need to be provided to the second modulator 306*b* of the second transmission module 306.

The information outputted from the second microprocessor 302 is modulated by the oscillation frequency generated from the second local oscillator 306*a*, and amplified to a sufficient amplitude through the second transmitting/amplifying unit 306*c* of the second transmission module 306, and then provided to the second transmission power amplifier 306*d*.

The second transmission power amplifier 306*d* power-amplifies the modulated transmission signal to a sufficient intensity and transmits it to the communication relay unit 40 through the antenna 30*a* and a transmitting/receiving separation unit such as the duplexer 306*e* (stage: ST208).

In this respect, referring to the time for transmitting the travel information of the link, that is, the information related to the travel distance 'd', the travel time 't' and the travel speed 'V', it is desirable to transmit the information after the probe vehicle 31 passes the ending point of the link, to thereby reduce the number of communication.

Meanwhile, as mentioned above, the link travel information modulated by the radio frequency terminal unit 30 may be transmitted to the communication relay unit 40 through the wireless communication network, or by using a communication beacon on roadsides.

Subsequently, the second microprocessor 302 of the radio frequency terminal unit 30 mounted in the probe vehicle 31 judges whether the travel information of the link was completely transmitted (stage: ST209). If the transmission is going on, it repeatedly performs the steps after the stage ST207, while if the transmission was completed, it collects the travel information of the next link in the same manner as described and transmits it.

As shown in FIG. 5, the communication relay unit 40 relays the signal transmitted through the wireless communication network (the public network) or the roadside communication beacon from the radio frequency terminal unit 30 of each probe vehicle 31, and transmits it to the service center.

Then, the service center 50 collects the signal as transmitted from each radio frequency terminal unit 30 of the probe vehicles 31 and relayed through the communication relay unit 40 through the antenna 50*a*, thereby recognizing the traffic flow information over the entire road and systematically managing it.

FIG. 6C is a detailed view of the service center 50 that collects and systematically manages the traffic flow information as relayed from the communication relay unit 40. The service center 50 will now be described in detail with reference to FIGS. 6C and 7C.

The service center 50 includes the communication server 500 and the database server 501.

The communication server 500 receives the modulated transmission signal inputted upon relaying through the communication relay unit 40 from each of the probe vehicles 31 through the antenna 50*a* and the plurality of modems 500*a* and 500*b* (stage: ST300).

The information related to the travel distance 'd', the travel time 't' and the travel speed 'V' in the link are extracted from the received signal (stage: ST301) and provided to the computer 500*c*.

The computer 500*c* of the communication server 500 analyzes the information extracted by the plurality of modems 500*a* and 500*b* (stage: ST302) to check whether there is an error therein (stage: ST303).

If there is an error at stage ST303, the computer 500*c* continuously receives the modulated signal through the communication relay unit 40, while, if there is no error, it transmits the information through the communication line to the database server 501.

The database server 501 systematically stores the travel information (travel distance, travel time, travel speed) by links as transmitted from the communication server 500 in the database 501*b* by using the engine 501*a* (stage: ST304).

When the travel information is completely stored in the database 501*b*, the database server 501 reads out the travel information by means of the engine 501*a* and transmits it to the application program 501*c*.

The application program 501*c* analyzes various travel information of each link collected from the various kinds of probe vehicles 31 (stage: ST305).

And then, based on the analyzed travel information, it computes the average value (representative value) of the travel distance, the travel time and the travel speed, and recognizes it as traffic flow information over the entire road and stores the same (stage: ST307).

The service center 50 recognizes the traffic flow information over the entire road informs drivers traveling on each road of the congested areas in advance through the traffic communication network, so that they can avoid that areas, or recommends to the drivers the fastest route to the destination before starting.

Meanwhile, according to an apparatus for collecting traffic information of another embodiment of the present invention, the travel distance, the travel time and the travel speed are obtained and transmitted through the communication relay unit 40 to the service center 50 without providing travel distance detector 304 and the travel time detector such as the timer 305 to the radio frequency terminal unit 30 as shown in FIG. 6B.

This can be accomplished in a manner that the distance between the starting point and the ending point of the link where the position transmitting device 20 is installed is actually measured and stored as a code value in the data recording medium such as the non-volatile memory unit 201 of the position transmitting device 20 together with the position information, and time information is periodically generated by the first microprocessor 202.

In detail, the first microprocessor 202 of the position transmitting device 20 reads out the starting point and the ending point of the position information stored in the data recording medium, and modulates it together with the time information through the first transmission module, and then transmits the same to the probe vehicle 31 traveling in the link.

Accordingly, as stated above, the second microprocessor 302 of the radio frequency terminal unit 30 mounted in the probe vehicle 31 recognizes the position of the probe vehicle 31 and the starting point and the ending point of the link merely on the basis of the position information, the distance information and the time information received through the receiving module 300, and also recognizes the travel distance and the travel time from the starting point to the ending point of the link.

And, after a travel speed is obtained on the basis of the travel distance and the travel time as recognized, they are modulated by the second transmission module 306 in the same manner as described above and then transmitted to the service center 50.

Meanwhile, comparatively, unlike in the conventional art in which the position of the vehicle is computed by receiving the radio waves to the probe vehicle from the GPS satellites and the computed position information is wirelessly collected by the map server of the service center to thereby map-match it with the starting point and the ending point of the link on the electronic map of its own, thereby obtaining the travel information, in the present invention, the position transmitting device installed at the starting point and the ending point of the link over the entire road wirelessly transmits its own position information, which is received by the radio frequency terminal unit of the probe vehicle traveling on the road, thereby obtaining the distance of the link and the time and speed required for traveling the link.

Resultantly, according to the present invention, the distance error between the GPS satellite and the GPS terminal and the impossibility to identify the current position of the probe vehicle in the invisible area are resolved. Also, the position information of the probe vehicle is transmitted only at the starting points and the ending points of the links, the communication expense can be minimized.

The present invention has an effect that the extent of congestion on the roads are quickly and accurately collected and informed to the drivers, so that the vehicles can be dispersed to the less congested area or the use time zone for the drivers can be dispersed, so that the limited road resource can be effectively utilized without any additional investment.

Evidently, according to the apparatus and method for collecting traffic information, by collecting the travel speed and the travel time of each link over the entire road by using the position transmitting device installed on roadsides and the radio frequency terminal unit mounted in the probe vehicle, the probe vehicle traveling on the road receives the wireless signal from the corresponding position transmitting device, so that the travel time and speed of each link can be accurately collected, and accordingly, the driver can be guided on the fastest route to his destination. Also, since the expected travel time to his destination can be informed without using the GPS satellites and the GPS terminal, the driver can save much time and expense, according to which energy consumption can be reduced. In addition, since the traffic flow can be accurately detected by time zones, the roads can be effectively designed and operated based on it.

What is claimed is:

1. A method for collecting traffic information comprising the steps of:

a position information transmitting step of installing a position transmitting device at a starting point and an ending point of a link of entire road and transmitting position information of the link to probe vehicles;

an information receiving/classifying/searching step of receiving a transmission signal of a corresponding position while traveling on a road, and continuously classifying and searching the intensity of the signal and the position information of the link;

receiving the signal through an antenna from the position transmitting device, and classifying the position information and the intensity of the received signal and outputting the same;

digitizing the intensity of the signal as classified by a receiving module;

measuring a travel distance of the probe vehicle according to a proportional expression of the number of the pulse inputted from the travel distance detector and a circumference of a wheel of the probe vehicle;

measuring time required for the probe vehicle to travel in the link;

computing a travel time, a travel distance and a travel speed of the link on the basis of the position information classified by the receiving module, the digital value according to the intensity of the signal and the measured distance and time;

modulating the information related to the travel time, the travel distance and the travel speed of the link obtained by a second microprocessor and transmitting the same through the antenna to a communication relay unit;

a travel information transmitting step of detecting the position of the probe vehicles and the starting point and the ending point of the link according to the result of searching, computing the time, the distance and the speed required for traveling the link on the basis of the detected information, and transmitting the same; and a traffic information managing step of receiving and systematically storing the travel information on the probe vehicles, computing a representative value for the travel information of each link, and recognizing and managing the traffic flow information on the entire road.

2. The method according to claim 1, wherein the position information is either one of an absolute coordinate value for the position transmitting device installed at a starting point and an ending point of the link or its identification number.

3. The method according to claim 1, wherein the travel information on the link where the probe vehicle traveled is transmitted after the probe vehicle passes the ending point of the link.

4. The method according to claim 1, wherein the travel distance refers to the distance from the starting point to the ending point of the link, which is obtained by the following equation:

Travel distance=n×I×1/m, wherein 'm' indicates the number of pulses when the wheel of the vehicle is rotated by one time, 'I' indicates the circumference of the wheel of the probe vehicle 31, and 'n' indicates the total number of the pulses for the distance that the probe vehicle traveled.

5. The method according to claim 1, wherein the travel information on the link is transmitted by using either one of a public network or a roadside communication beacon.

6. A method for collecting traffic information comprising:

a link information transmitting step of installing a position transmitting device at a starting point and an ending point of a link of the entire road, and transmitting position information on the link, distance information from the starting point to the ending point of the link and timeinformation to probe vehicles;

an information receiving/classifying step of receiving a transmission signal of a corresponding position while traveling on the road, and classifying the position information, the distance information and the time information of the link;

a travel information transmitting step of detecting a starting point and an ending point of the link on the basis of the position information of the link, obtaining a travel time, a travel distance and a travel speed in the link on the basis of the classified time information and distance information obtained by traveling from the starting point to the ending point of the link as detected, and transmitting the same;

a traffic information managing step of receiving and systematically storing the travel information on the probe vehicle by links, computing a representative value for the stored travel information of each link, and recognizing and managing traffic flow information on the entire road;

receiving the signal through an antenna from the position transmitting device, and classifying the position information and the intensity of the received signal and outputting the same;

digitizing the intensity of the signal as classified by the receiving module;

measuring a travel distance of the probe vehicle according to a proportional expression of the number of the pulse inputted from the travel distance detector and a circumference of a wheel of the probe vehicle;

measuring time required for the probe vehicle to travel in the link;

computing a travel time, the travel distance and the travel speed of the link on the basis of the position information classified by the receiving module, the digital value according to the intensity of the signal and the measured distance and time; and modulating the information related to the travel time, the travel distance and the travel speed of the link obtained by a microprocessor and transmitting the same through the antenna to a communication relay unit.

7. An apparatus for collecting traffic information comprising:

a position transmitting device installed at a starting point and an ending point of a link of the entire road and transmitting position information with a suitable intensity to a probe vehicle traveling in the link;

a radio frequency terminal unit mounted in the probe vehicle traveling in the link for receiving position information, detecting a travel distance and a travel time required for the probe vehicle to travel in the link according to the received position information, and computing a travel speed to transmit it to a public network;

a communication relay unit for receiving the travel information of each link as collected by the probe vehicle while traveling in the link and relaying the same;

a service center for obtaining average values of the travel distance, the travel time and the travel speed of each link as relayed through the communication relay unit, and managing the traffic flow information on the entire road;

wherein the radio frequency terminal unit includes a receiving module for receiving the signal through the antenna from the position transmitting device, and classifying the position information and the intensity of the received signal and outputting the same;

an analog-to-digital converter for digitizing the intensity of the signal as classified by the receiving module;

a travel distance detector for measuring a travel distance of the probe vehicle and generating a pulse in proportion to the travel distance;

a travel time detector for measuring time required for the probe vehicle to travel in the link;

a second microprocessor for computing a travel time, a travel distance and a travel speed of the link on the basis of the position information classified by the receiving module, the digital value according to the intensity of the signal and the measured distance and time; and a second transmission module for modulating the information related to the travel time, the travel distance and the travel speed of the link obtained by the second microprocessor and transmitting the same through the antenna to the communication relay unit.

8. The apparatus according to claim 7, wherein the position transmitting device includes:

a recording medium for receiving the position information on the link as a code value and storing the same;

a first transmission module for modulating the position information as coded and stored in the recording medium and transmitting it through an antenna to the probe vehicle; and a first microprocessor for coding and providing the position information on the link to the recording medium, and controlling the transmission operation of the first transmission module in due order in transmitting the position information.

9. The apparatus according to claim 8, further comprising a data converter for converting the position information on the link as coded and stored in the recording medium to a bit stream and outputting it to the first transmission module.

10. The apparatus according to claim 7, wherein the service center includes:

a communication server for receiving the travel information of each link as relayed by the communication relay unit and detecting whether there is an error; and a database server for systematically storing and analyzing the travel information by links as obtained by the communication server, and obtaining average values of the travel distance, the travel time and the travel speed of the analyzed travel information of each link of the probe vehicles, to thereby recognize and manage the traffic flow information over the entire road.

* * * * *